US005101931A

United States Patent [19]

Blass et al.

[11] Patent Number: 5,101,931

[45] Date of Patent: Apr. 7, 1992

[54] DISCHARGE MUFFLER AND METHOD

[75] Inventors: Jaroslav Blass; Hubert Bukac, both of Sidney, Ohio

[73] Assignee: Copeland Corporation, Sidney, Ohio

[21] Appl. No.: 528,026

[22] Filed: May 23, 1990

[51] Int. Cl.[5] ..... F01N 7/10

[52] U.S. Cl. ..... 181/240; 181/403

[58] Field of Search ..... 181/240, 255, 266, 269, 181/275, 403; 415/119

[56] References Cited

U.S. PATENT DOCUMENTS 3,663,127 5/1972 Cheers .
3,687,019 8/1972 Wolf .
3,750,840 8/1973 Holme ..... 181/403 X
4,109,751 8/1978 Kabele ..... 181/255 X
4,330,239 5/1982 Gannaway ..... 181/403 X
4,343,599 8/1982 Kousokabe .
4,784,453 11/1988 Bar ..... 181/403 X
4,870,745 2/1986 Sparks et al. ..... 181/269 X

*Primary Examiner*—L. T. Hix
*Assistant Examiner*—Eddie C. Lee
*Attorney, Agent, or Firm*—Harness, Dickey & Pierce

[57] ABSTRACT

A compressor discharge gas muffler comprising a single expansion chamber and an impedence tube for attenuation the fundamental low frequency discharge gas pulses, and a side outlet positioned to attenuate higher frequencies. A method of attenuation is also disclosed.

16 Claims, 3 Drawing Sheets

DISCHARGE MUFFLER AND METHOD

BACKGROUND AND SUMMARY OF THE INVENTION

The present invention relates to mufflers and more particularly to an improved discharge gas muffler for refrigerant compressors.

In the case of refrigerant compressors used for air conditioning and heat pump applications, sound has become an increasingly important criteria for judging acceptability. Accordingly, there is a demand for improved refrigerant compressors which are quieter than those presently available but sacrificing none of the advantages of existing compressors.

It is therefore a primary object of the present invention to provide a refrigerant compressor having improved discharge gas muffler which is relatively simple in construction, and does not result in a significant loss of efficiency.

Other advantages and features will become apparent from the following specification taken in connection with the accompanying drawings.

DESCRIPTION OF THE PREFERRED EMBODIMENT

Figure 1:
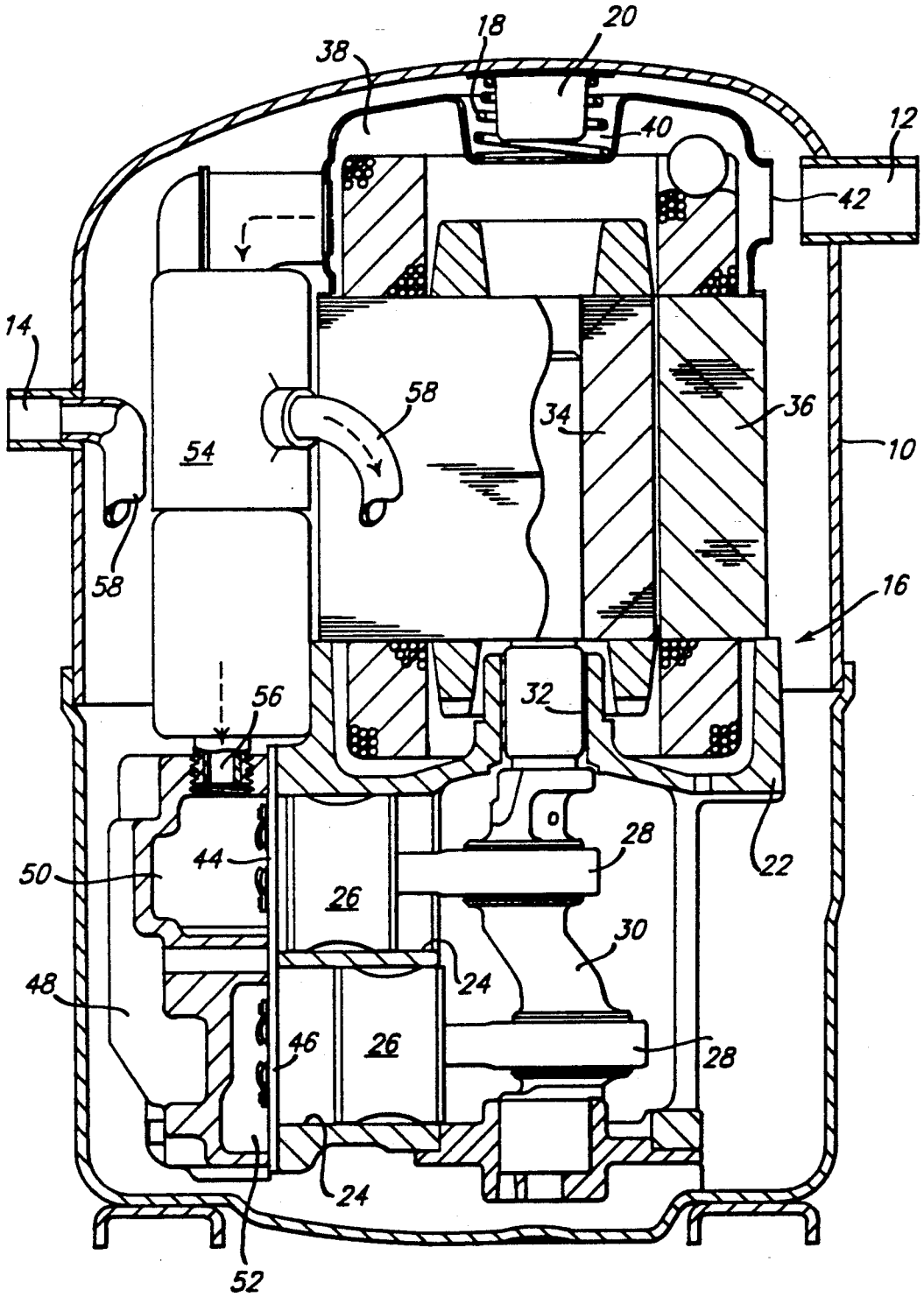
FIG. 1 is a vertical sectional view of a multi-cylinder hermetic refrigerant compressor incorporating a discharge gas muffler embodying the principles of the present invention.

The present invention is illustrated for exemplary purposes embodied in a two cylinder reciprocating compressor. The major components of the compressor include a hermetic shell 10, a suction gas inlet fitting 12, a discharge gas outlet fitting 14, and a motor-compressor unit 16 disposed therein and spring supported in the usual manner (not shown) and positioned at the upper end by means of a spring 18 located on a sheet metal projection 20. The motor compressor unit 16 generally comprises a compressor body 22 defining a plurality of pumping cylinders 24 (two parallel radially disposed cylinders in this case), in each of which is disposed a reciprocating pumping member in the form of a piston 26 connected in the usual manner by connecting rod 28 to a crankshaft 30 rotationally journalled in a bearing 32 disposed in body 22 The upper end of crankshaft 34 is affixed to a motor rotor 34 rotatively disposed within a motor stator 36, the upper end of which is provided with a motor cover 38 which has a recess 40 receiving spring 18 and an inlet opening 42 positioned to receive suction gas entering through fitting 12 for purposes of motor cooling prior to induction into the compressor. Each cylinder 24 in body 22 is opened to an outer planar surface 44 on body 22 to which is bolted the usual valve plate assembly 46 and cylinder head 48, all in the usual manner. Cylinder head 48 defines interconnected discharge gas chambers 50 and 52 which receive the discharge gas pumped by the compressor through discharge valve assemblies 51 and 53 respectively. Up to this point the compressor as described is known in the art and the essential details thereof are disclosed in the U.S. Pat. No. 4,412,791 the disclosure of which is hereby incorporated herein by reference, and more particularly in co-pending application Ser. No. 509,334, filed Apr. 13, 1990 and entitled Refrigerant Compressor, the disclosure of which is herein incorporated by reference.

The novelty in the present invention resides in the design of the discharge gas muffler 54, which is threadably affixed to head 48 in a sealing relationship by means of a fitting 56. Discharge gas exits muffler 54 via a tube 58 which winds its way through the space between motor-compressor 16 and shell 10 in the usual manner with the downstream end thereof being sealingly affixed to a discharge fitting 14 which extends through shell 10 to connect the compressor to the system being supplied refrigerant under pressure.

Figure 4:
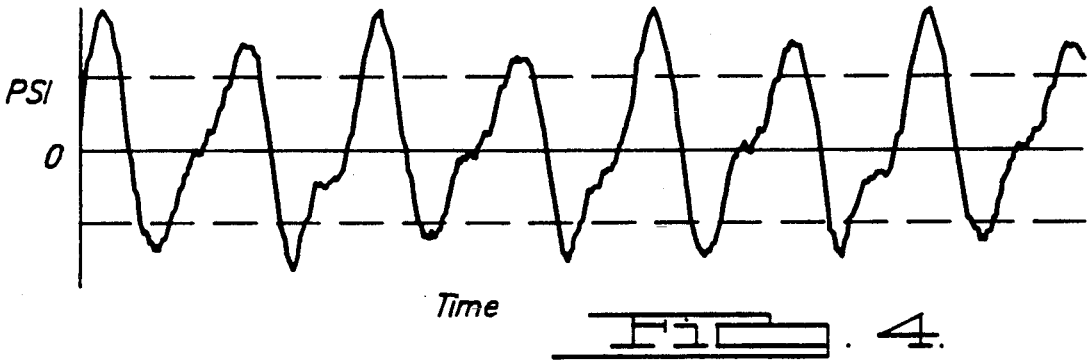
FIG. 4 is a plot of discharge gas pressure pulse versus time.
Figure 5:
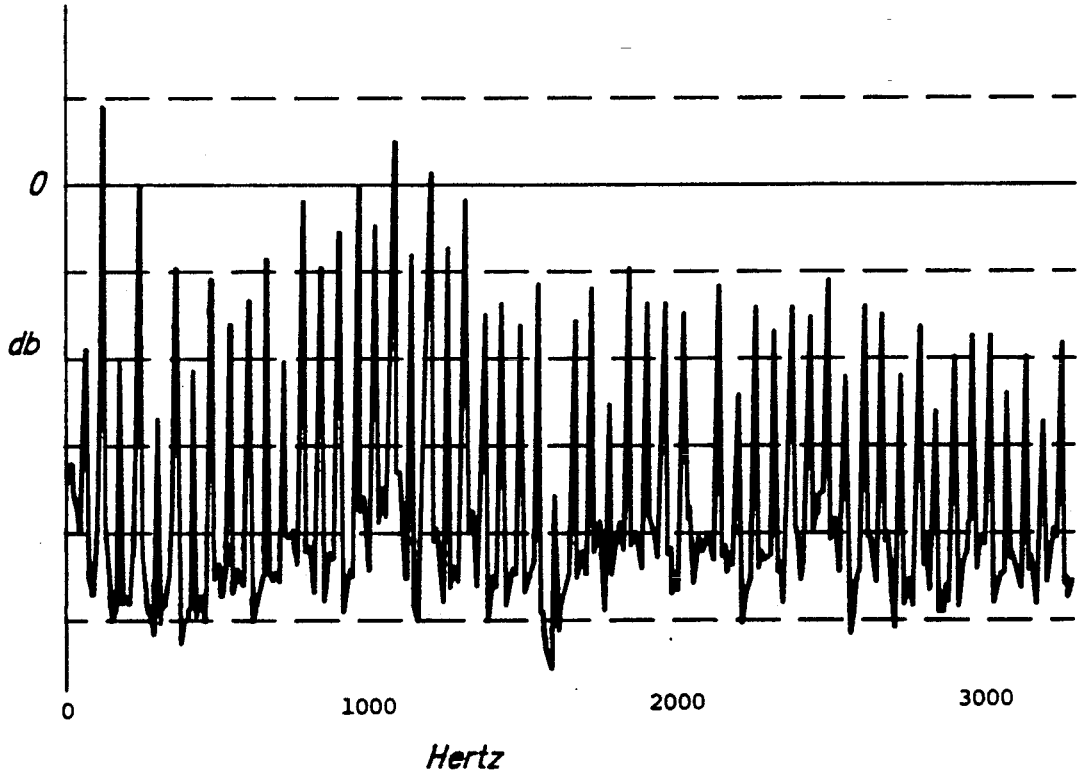
FIG. 5 is a plot of the data of FIG. 4, but showing it in terms of db versus hertz.

In designing the muffler, the basic objective is to attenuate not only the low frequency discharge pressure pulsations, but also the high frequency components of these pulsations. To do this it is first necessary to determine the fundamental harmonic frequency to be attenuated, i.e., the fundamental low frequency pulsation. This is done by applying the following equation: $F_L = rpm \times n/60$ where $F_L$ is the frequency of the fundamental low frequency pulsation, rpm is the revolutions per minute of the compressor and n is the number of cylinders discharging per revolution into the muffler. The resultant pulsation is often in the 100 to 120 hertz range for a two cylinder compressor. The high frequency components requiring attenuation are determined by actual measurement of the machine in question. First a plot of discharge pressure versus time is made using a pressure transducer located several feet from an unmuffled compressor in the discharge line with anechoic termination. FIG. 4 is representative of such a plot. The data of FIG. 4 is then subjected to a conventional Fourier analysis to provide a plot of magnitude of the pressure pulsations versus frequency. This plot, such as the representative one shown in FIG. 5. clearly reveals (visually) the high frequencies which are the noisiest and hence require attenuation (e.g., in the area of 1,000 hertz in FIG. 5). In evaluating this plot, the high peaks in the 100–120 hertz range are ignored because they are the fundamental low frequency pulsation and will be attenuated by attenuation of the fundamental low frequency.

In designing the actual muffler, it has been found that an effective design for attentuation of the lower frequencies is the use of the single expansion chamber principle in combination with an impedance tube. Viewed as a single expansion chamber, attentuation is a function of the length $L_C$ of the chamber, the cross-sectional area $A_C$ of the chamber and the cross-sectional areas $A_T$ of the inlet and outlet tubes. For maximum attenuation of $F_L$ the length $L_C$ of the chamber should be one-quarter of the wave length $L_W$ of the frequency being attenuated. The wave length is calculated using the equation $L_W \doteq c/F_L$ where c is the speed of sound in the gas being compressed at gas discharge conditions.

Figure 2:
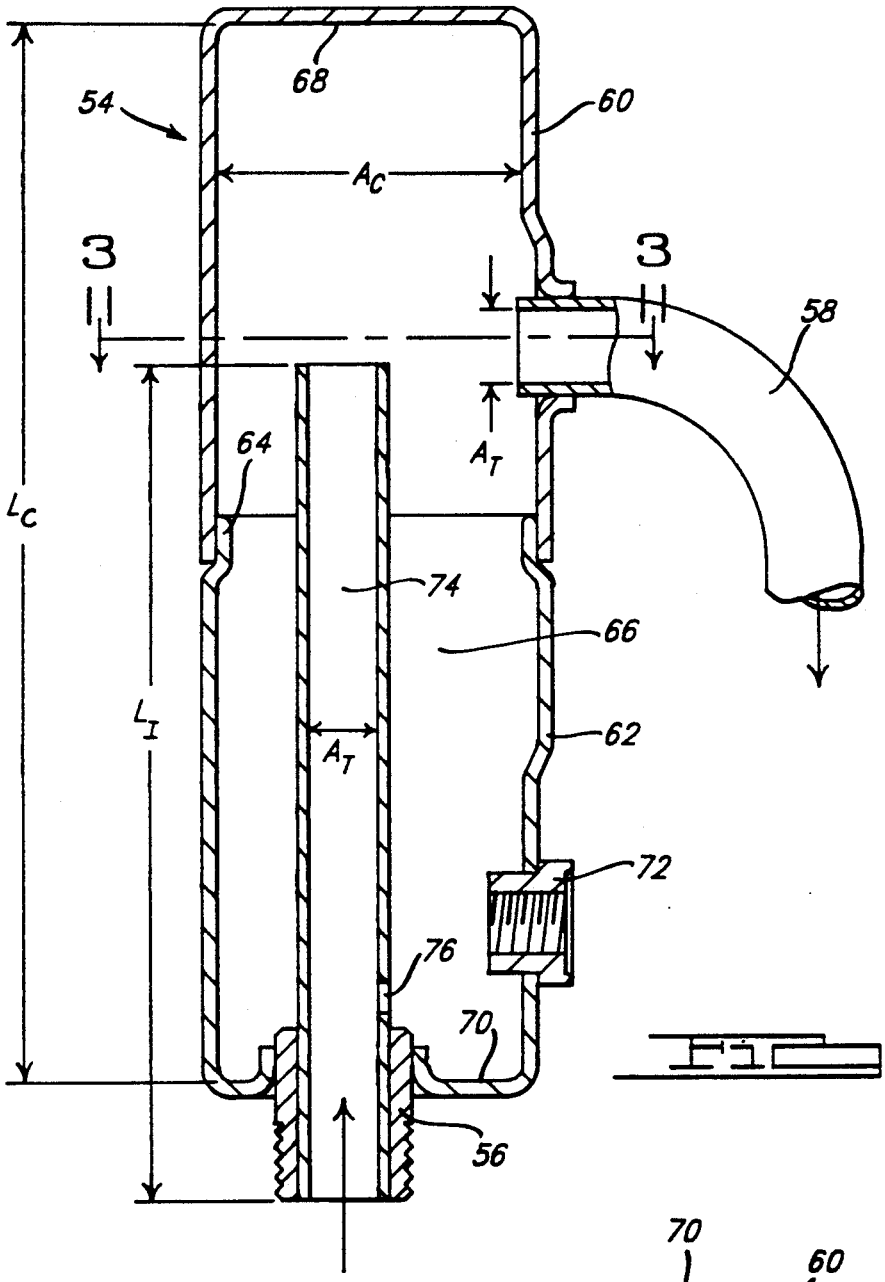
FIG. 2 is an enlarged vertical sectional view of the discharge gas muffler of the present invention.
Figure 3:
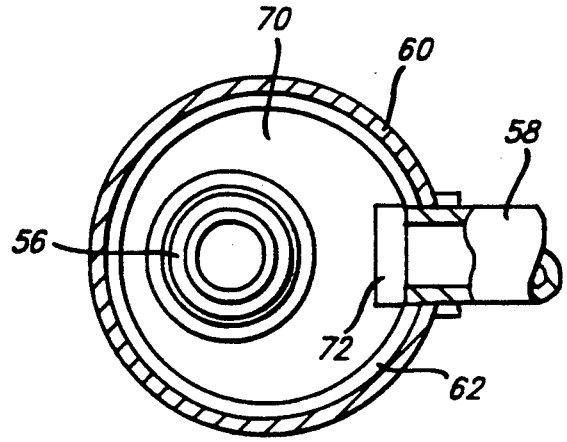
FIG. 3 is a sectional view taken substantially along line 3—3 in FIG. 2.

The muffler 54 can be constructed as best shown in FIG. 2, comprising two relatively rigid stamped sheet metal cup members 60 and 62 telescoped and brazed together at 64 to define an elongated chamber 66 of generally circular cross-section for stiffness and having relatively flat parallel end walls 68 and 70 for sound wave stability. The cross-sectional area of chamber 66 is indicated at $A_C$ and the cross-sectional area of the inlet and outlet passages is indicated at $A_T$. The length of chamber 66 is indicated at $L_C$. A standard fitting 72 may be brazed in the side wall of the muffler for threadably receiving in the normal manner an IPR valve (not shown). Its location does not appear to have any significant accoustic effect. Because the amount of attenuation of a single expansion chamber is a direct function of the ratio of $A_C/A_T$ the diameters of the inlet and outlet passages $A_T$ are chosen to be as small as possible without causing significant flow losses. The diameter $A_C$ of chamber 66 is conversely chosen to be as large as possible as dictated by the space available for the muffler and cost considerations.

As can be seen in FIG. 2, muffler 54 also comprises an impedance tube 74 disposed within chamber 66 and sealingly connected at one end to fitting 56 and being open at the opposite end. Impedance tube 74 is preferably straight and parallel to the longitudinal axis of chamber 66 and generally centrally located therein. It has a length $L_I$ and aforesaid internal cross-sectional area $A_T$. It also has a small oil drain hole 76 adjacent the lower end thereof which has no accoustical effect. The impedance tube makes the muffler also function as a resonator to attenuate the low fundamental frequency in accordance with the following relationship:

$$\sqrt{2} \cdot F_L \leqq \frac{c}{2\,\mathrm{pi}} \sqrt{A_T/[(V_1 + V_2)/(L_I + \sqrt{A_T})]}$$

where $V_1$ is the combined volume of discharge chambers 50 and 52, and $V_2$ is the volume of chamber 66 less the volume occupied by impedance tube 74 in chamber 66. Using this relationship $L_1$ can be calculated. To get a practical value it may be necessary to readjust $V_I$ and $V_2$ one or more times.

The attentuation of higher frequency components is much more difficult and can be achieved either analytically or experimentally. It has been found that by using empirical techniques it is possible to attenuate the high noted frequencies by finding minimum nodes of a standing wave of the particular frequency of interest. This is accomplished by placing a plurality of appropriate transducers along the longitudinal length of the chamber wall. The compressor is then operated and a FIG. 4 type plot and a corresponding FIG. 5 type plot (based on Fourier analysis) is created for each transducer location. The location chosen for the discharge tube is the one where the magnitude of the pulsations for the desired frequency is at a minimum. It is believed that will be the location of a node point for the standing wave of the frequency to be attenuated.

It has been discovered that the attenuation achieved with the construction of the present invention is a significant improvement over many known designs in that it provides approximately a 50% reduction in discharge pressure pulses without any significant loss of efficiency (i.e., the compressor will be of substantially the same efficiency as it would be without any discharge muffler at all). Furthermore, it should be noted that the advantages of the present invention may be achieved with other than reciprocating type compressors, such as, for example, rotary, scroll, vane and other like compressors.

While it will be apparent that the preferred embodiment of the invention disclosed are well calculated to provide the advantages above stated, it will be appreciated that the invention is susceptible to modification, variation and change without departing from the proper scope or fair meaning of the subjoined claims.

What is claimed is:

1. A compressor discharge gas muffler comprising:

(a) a shell defining a generally cylindrical sound attenuation chamber having a longitudinal axis, said chamber being elongated having a length $L_C$ and having generally flat parallel opposed end walls and having a cross-sectional area $A_C$;

(b) an inlet opening disposed in one of said end walls and defining a gas inlet therethrough;

(c) an impedance tube having a center axis, an outlet end, and an inlet end, said inlet end sealingly connected to said inlet opening for receiving gas entering said muffler through said inlet opening, said tube being straight and of a length $L_1$, and of a uniform internal cross-sectional area $A_T$, the center axis of said tube extending generally parallel to the longitudinal axis of said shell and being generally perpendicular to said end walls; and (d) an outlet opening disposed in a side wall of said shell and defining as gas outlet therethrough, said outlet opening being disposed a distance D in a direction parallel to said longitudinal axis from said one end wall;

(e) said muffler being configured with $L_C$ and ratio of $A_C/A_T$ chosen to provide maximum attenuation of discharge gas pulses at a relatively low frequency equal to approximately the number of compressor gas discharges per second at normal operating speeds, and said distance D being chosen to provide maximum attenuation of peak-frequency gas pulses in a range of approximately 600 hertz to approximately 3600 hertz.

2. A compressor gas discharge gas muffler as claimed in claim 1 wherein said shell is formed of two generally cup-shaped members each having an open end defining a peripheral edge, said peripheral edges being connected together in a sealing relationship.

3. A compressor gas discharge gas muffler as claimed in claim 1 wherein said chamber is generally circular in cross-section.

4. A compressor gas discharge gas muffler as claimed in claim 1 wherein said outlet opening is disposed in approximately transverse alignment with the outlet end of said impedance tube.

5. A compressor gas discharge gas muffler as claimed in claim 1 wherein said muffler has a longitudinal axis disposed generally vertically with said inlet opening at a lower end thereof, and further comprising a relatively small drain hole at a lower end of said impedance tube for draining any lubricating oil that might collect in said chamber downwardly by gravity through said inlet opening.

6. A compressor gas discharge gas muffler as claimed in claim 1 wherein the compressor has a discharge gas chamber of volume $V_1$ to which said muffler is connected and wherein the volume of said sound attenuation chamber is $V_2$, said impedance tube length $L_1$ and said volumes being chosen to satisfy the following relationship:

$$\sqrt{2} \cdot F_L \leqq \frac{c}{2\,\mathrm{pi}} \sqrt{A_T/[(V_1 + V_2)/(L_I + \sqrt{A_T})]}$$

where $F_L$ is a lower frequency being attenuated and c is the speed of sound in the discharge gas at gas discharge conditions.

7. A compressor gas discharge gas muffler as claimed in claim 6 wherein said shell is formed of two generally cup-shaped members each having an open end defining a peripheral edge, said peripheral edges being connected together in a sealing relationship.

8. A compressor gas discharge gas muffler as claimed in claim 6 wherein said chamber is generally circular in cross-section.

9. A compressor gas discharge gas muffler as claimed in claim 6 wherein said outlet opening is disposed in approximately transverse alignment with the outlet end of said impedance tube.

10. A compressor gas discharge gas muffler as claimed in claim 1 wherein said chamber is free of any baffles or partitions.

11. A compressor discharge gas muffler comprising:

(a) a shell formed of two generally cup-shaped members each having an open end defining a peripheral edge, said peripheral edges being connected together in a sealing relationship to thereby define a generally cylindrical sound attenuation chamber having a longitudinal axis, said shell being elongated with generally flat parallel opposed end walls and being generally circular in cross-section;

(b) an inlet fitting disposed generally centrally in one of said end walls and defining gas inlet opening therethrough;

(c) an impedance tube having at one end an inlet sealingly connected to said inlet fitting for receiving gas entering said muffler through said inlet opening, said impedance tube being straight and of a uniform cross-sectional area for the entire length thereof and being open at the end thereof opposite said inlet, said tube having a center axis extending generally parallel to the longitudinal axis of said sound attenuation chamber and being generally perpendicular to said end walls; and (d) an outlet fitting disposed in a side wall of said shell and defining an outlet opening therethrough;

12. A compressor gas discharge gas muffler as claimed in claim 11 wherein the compressor has a discharge gas chamber of volume $V_1$ to which said muffler is connected and wherein the volume of said sound attenuation chamber is $V_2$, said impedance tube length $L_1$ and said volume being chosen to satisfy the following relationship:

$$\sqrt{2} \cdot F_L \leqq \frac{c}{2\,\mathrm{pi}} \sqrt{A_T/[(V_1 + V_2)/(L_I + \sqrt{A_T})]}$$

where $F_L$ is a lower frequency being attenuated and c is the speed of sound in the discharge at gas discharge conditions.

13. A method of constructing a compressor gas discharge muffler, comprising the steps of:

(a) calculating a fundamental low frequency to be attenuated;

(b) determining a highest amplitude higher frequency to be attenuated;

(c) fabricating a longitudinally extending muffler chamber having a longitudinally extending side wall having a length $L_C$ and a cross-sectional area $A_C$, and end walls having inlet and outlet openings respectively each having an internal cross-sectional area $A_T$, all chosen to achieve maximum practical attenuation of said fundamental low frequency;

(d) positioning in the muffler chamber a longitudinally disposed impedance tube communicating with the inlet opening and having a length chosen to attenuate said fundamental low frequency;

(e) determining empirically a location longitudinally along said side wall of the muffler where said higher frequency has a minimum amplitude; and (f) locating the outlet opening approximately at said location.

14. The method as claimed in claim 13 wherein said higher frequency is determined empirically.

15. The method as claimed in claim 14 wherein said location is determined by measuring discharge gas pressure pulses along the length of the muffler chamber.

16. A method of constructing a compressor gas discharge muffler, comprising the steps of:

(a) calculating a fundamental low frequency to be attenuated;

(b) fabricating a longitudinally extending muffler chamber having a longitudinally extending side wall having a length $L_C$ and a cross-sectional area $A_C$, and end walls having inlet and outlet openings respectively each having an internal cross-sectional area $A_T$, all chosen to achieve maximum practical attenuation of said fundamental low frequency; and (c) positioning in the muffler chamber a longitudinally disposed impedance tube communicating with the inlet opening and having a length chosen to attenuate said fundamental low frequency.

* * * * *

UNITED STATES PATENT AND TRADEMARK OFFICE

CERTIFICATE OF CORRECTION

PATENT NO. : 5,101,931

DATED : April 7, 1992

INVENTOR(S) : Jaroslav Blass and Hubert Bukac

It is certified that error appears in the above-identified patent and that said Letters Patent is hereby corrected as shown below:

On the title page, under U.S. Patent Documents, reference "Bar", "4,784,453" should be -- 4,784,583 --.

On the title page, under U.S. Patent Documents, reference "Sparks, et al", "4,870,745" should be -- 4,570,745 --.

Abstract, line 2, "impedence" should be -- impedance --.

Abstract, line 2-3, after "attenuation" insert -- of --.

Column 1, line 56, after "22" insert -- . --.

Column 2, line 43, "." (second occurrence) should be -- , --.

Column 2, line 55, "attentuation" should be -- attenuation --.

Column 3, line 38, "$L_1$" should be -- $L_I$ --.

Column 3, line 39, "$V_I$" should be -- $V_1$ --.

Column 3, line 41, "attentuation" should be -- attenuation --.

UNITED STATES PATENT AND TRADEMARK OFFICE

CERTIFICATE OF CORRECTION

PATENT NO. : 5,101,931

DATED : April 7, 1992

INVENTOR(S) : Jaroslav Blass and Hubert Bukac

It is certified that error appears in the above-identified patent and that said Letters Patent is hereby corrected as shown below:

Column 4, line 2, "are" should be — is —.

Column 4, line 21, "$L_1$" should be — $L_I$ —.

Column 4, line 27, "as" should be — a —.

Column 4, line 66, "$L_1$" should be — $L_I$ —.

Column 6, line 1, "$L_1$" should be — $L_I$ —.

Column 6, line 9, after "discharge" insert — gas —.

Signed and Sealed this

Twelfth Day of October, 1993

*Attest:*

*Attesting Officer*

BRUCE LEHMAN

*Commissioner of Patents and Trademarks*